United States Patent [19]

Yates

[11] 4,281,571

[45] Aug. 4, 1981

[54] PAPER CUTTER ASSEMBLY

[76] Inventor: Rowland K. Yates, 3413 Woodvale Dr., Midwest City, Okla. 73110

[21] Appl. No.: 68,826

[22] Filed: Aug. 22, 1979

[51] Int. Cl.[3] ..... B26F 3/00

[52] U.S. Cl. ..... 83/542; 83/582; 83/649; 83/651.1

[58] Field of Search ..... 83/542, 651.1, 649, 83/582

[56] References Cited

U.S. PATENT DOCUMENTS

| | | | |
|---|---|---|---|
| 1,197,553 | 9/1916 | Schumacher et al. | 83/651.1 X |
| 1,469,325 | 10/1923 | MacDonald | 83/542 |
| 1,595,097 | 8/1926 | Howell | 83/651.1 X |
| 1,636,812 | 7/1927 | Donovan | 83/651.1 X |
| 2,037,856 | 4/1936 | Filippi | 83/651.1 |
| 2,609,047 | 9/1952 | Wilkoff | 83/542 X |
| 3,097,557 | 7/1963 | Langstaff | 83/651.1 X |
| 3,561,312 | 2/1971 | Jones | 83/485 |
| 3,756,111 | 9/1973 | Weldenmiller | 83/651.1 |
| 3,821,916 | 7/1974 | Ricci et al. | 83/200.1 |
| 3,981,215 | 9/1976 | Granger et al. | 83/455 |

FOREIGN PATENT DOCUMENTS

| | | | |
|---|---|---|---|
| 60908 | 5/1943 | Denmark | 83/542 |
| 338769 | 7/1921 | Fed. Rep. of Germany | 83/542 |

*Primary Examiner*—Frank T. Yost

*Attorney, Agent, or Firm*—Donald J. Singer; Jacob N. Erlich

[57] ABSTRACT

A paper cutter assembly for use in combination with a supported roll of paper. The assembly, comprises a displaceable stationary single-strand cutter wire member that is positioned under and across the width of the paper roll, and a movable paper-cutting assisting subassembly that includes a pulley member disposed on the cutter wire member, and a handle member that is removably connected to the pulley member. When the pulley member is pulled by the operator toward himself and across the width of the unrolled paper with the use of the handle member, the cutter wire member is displaced toward the operator, the unrolled paper is cut in a straight and clean condition across its width, and is severed from the rest of the roll of paper in a quick and safe manner by the movement of the displaced wire member.

3 Claims, 9 Drawing Figures

PAPER CUTTER ASSEMBLY

STATEMENT OF GOVERNMENT INTEREST

The invention described herein may be manufactured and used by or for the Government for governmental purposes without the payment of any royalty thereon.

BACKGROUND OF THE INVENTION

This invention relates to the paper cutter art and, more particularly, to a paper cutter assembly for use in combination with a roll of paper and also in combination with a means for supporting and unrolling the paper from the roll.

Paper cutters per se are old, as is the use of wire cutting element(s) of a paper cutter. Nevertheless, wire paper cutters are being used even presently as attachments in modern, recent-technology devices.

One recent and current application of a wire paper cutter is as an attachment to an "Ozalid" print reproduction machine that is commonly referred to as the "Bruning 860" (i.e., Model 860, manufactured by, and commercially available from, the Bruning Division of Addressograph Multigraph Corporation, 1834 Walden Office Square, Schaumburg, Ill. 60172). As will be shown and more fully described later herein, the reproduction paper for the "Bruning 860" is on a roll, is unrolled for use, and is cut the necessary length (across its width) with a multiple-strand cutter wire that is used in combination with a hand-graspable movable member. Unfortunately, the use of this wire paper cutter results in the shredding and fraying of some of the constituent wire elements of the multiple-strand cutter wire, and a rough and sometimes crooked edge tear of the unrolled paper, and also danger to the operator because of puncture or cutting (by the frayed cutter wire) of the operator's hand which is grasping and is moving the movable member of the paper cutter.

I have invented a wire paper cutter assembly that is useable with the "Bruning 860" without any of the inherent disadvantages of the wire paper cutter presently used. I have, therefore, significantly advanced the state-of-the-art.

SUMMARY OF THE INVENTION

The invention is a wire paper cutter assembly which, in combination with a roll of paper and also in combination with a means for supporting and unrolling the paper from the roll, permits a straight and clean cut of the unrolled paper and severance of the paper from the rest of the roll, is simple and quick to operate, can be attached to, for use with, a "Bruning 860" and other similar devices, and, most importantly, presents no danger whatsoever to the operator.

The principal object, therefore, is to teach the structure of such a unique wire paper cutter assembly, as illustrated by a preferred embodiment thereof.

This principal object, as well as related objects, of this invention will become readily apparent after a consideration of the description of the invention, together with reference to the Figures of the drawings.

DESCRIPTION OF THE PREFERRED EMBODIMENT

Figure 1:
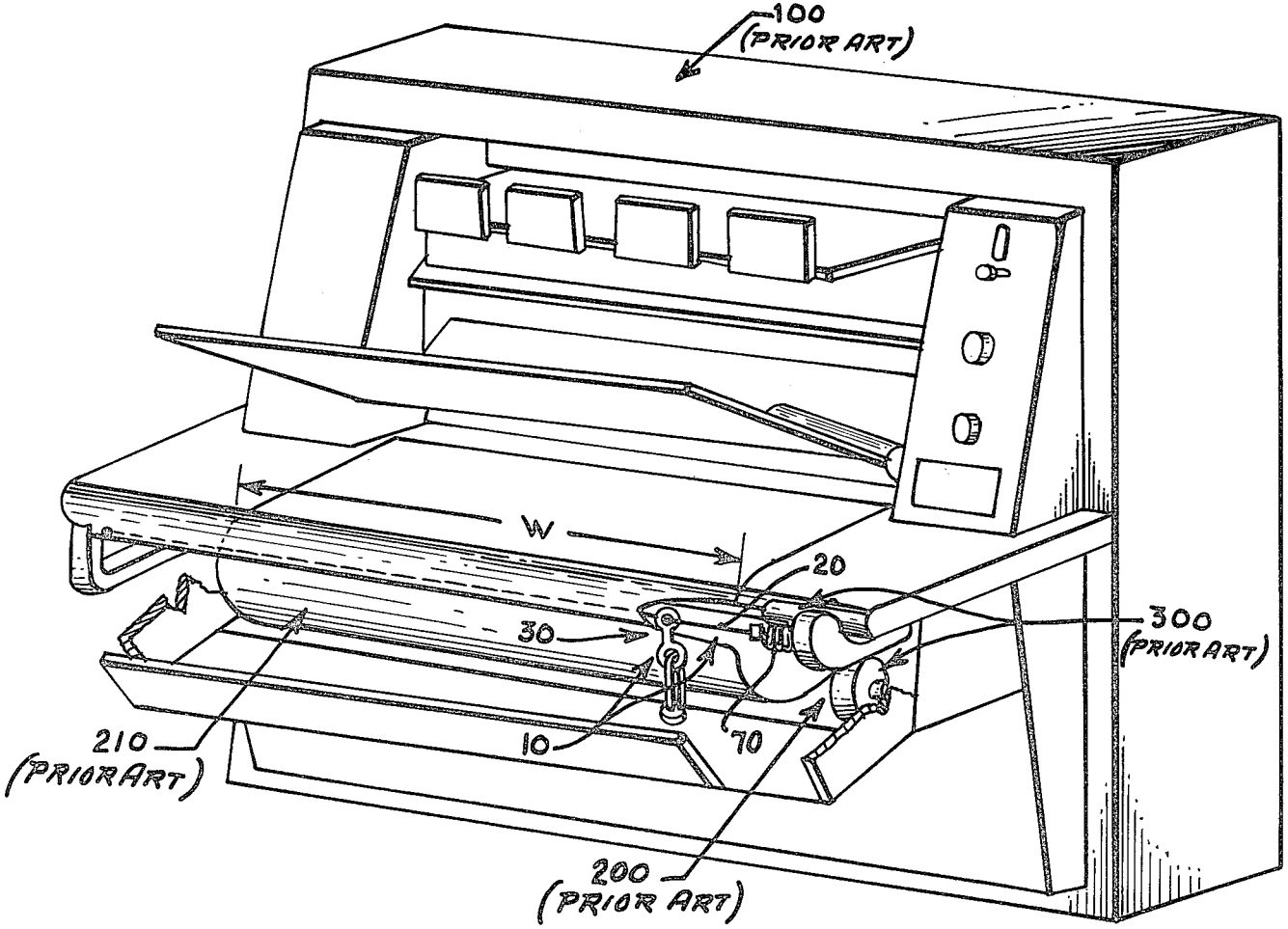
FIG. 1 is a perspective view, in simplified form, both schematic and pictorial, and partially fragmented, of a "Bruning 860" copying machine together with a roll of paper, means for supporting and unrolling the paper from the roll, and a preferred embodiment of the invention.
Figure 2:
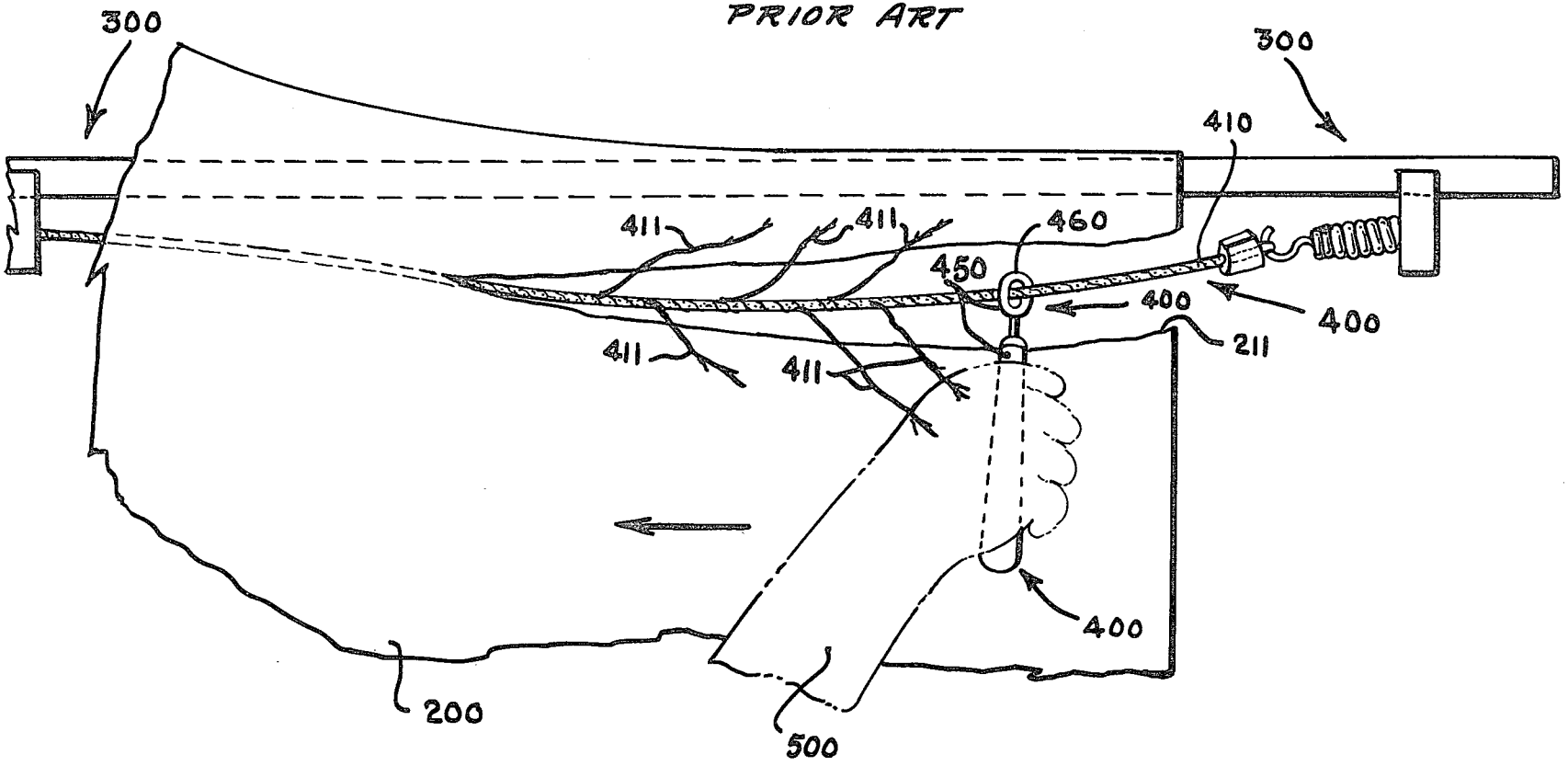
FIG. 2 PRIOR ART
FIG. 2 is a front view in simplified pictorial and schematic form of a prior art wire paper cutter assembly used with the "Bruning 860" shown in FIG. 1.
Figure 3:
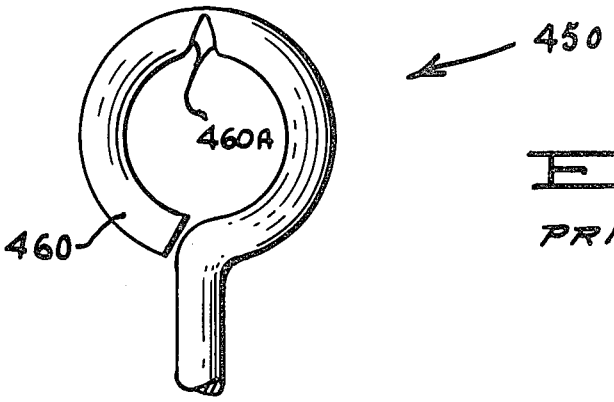
FIG. 3 PRIOR ART
FIG. 3 is a side elevation view, in pictorial form and partially fragmented, of a constituent member of the prior art wire paper cutter assembly, shown in FIG. 2, after relatively little use.

As a preliminary matter, reference is made to the prior art, as shown in FIGS. 1–3, inclusive. In FIG. 1 is shown the "Bruning 860" copying machine 100, together with: a roll 200 of paper 210 having a width "W"; and, means, generally designated 300, for supporting and unrolling the paper 210 from the roll 200. Also shown in FIG. 1, and not prior art, is the preferred embodiment, generally designated 10, of my inventive paper cutter assembly. In FIG. 2 is shown, enlarged and in detail, the prior art paper cutter assembly, generally designated 400, that is presently used with the "Bruning 860" copying machine 100, FIG. 1. That cutter assembly 400 is shown in use, with the resultant: shredding and fraying of some of the constituent wire elements 411 of the multiple-strand cutter wire 410; rough and crooked edge tear 211 of the unrolled paper 210; and, danger to the operator 500, because of the puncture or cutting (by the shredded and frayed multiple-strand cutter 410) of the operator's hand 510, which is grasping and is moving the movable member 450 of the prior art paper cutter assembly 400. It is to be noted that the prior art movable member 450, FIG. 2, includes an eye bolt 460, FIGS. 2 and 3, which surrounds the prior art multiple-strand wire 410, FIG. 2; and, in turn, the shredded and frayed wires 411 of the multiple-strand wire 410 cut into and severely damage the eye bolt 460, as is shown by the designation 460 A, FIG. 3. With each sweeping movement of the movable member 450, FIG. 2, to cut the unrolled paper 210, the condition of the multiple-strand cutter wire 410 and of the eye bolt 460 becomes worse, with resultant poorer cutting characteristics and more danger to the operator's hand 510.

Now, with reference to my unique paper cutter assembly 10, FIGS. 1 and 4–6, inclusive, it is to be remembered that the assembly 10 is to be used, as shown in FIG. 1, in combination with the roll 200 of paper 210 having a width "W", and with the means 300 for supporting and unrolling the paper 210 from the roll 200.

In the most basic and generic structural form, my paper cutter assembly 10, FIGS. 1 and 4–6, inclusive, includes (as can best be seen in FIGS. 1 and 4) a displaceable stationary single-strand cutter wire member 20 that is disposed across the width "W" of the roll 200 of paper, and simultaneously is disposed so as to be adjacent to (i.e., under and along) the paper 210 when it is unrolled; and, means (cooperatively useable with the cutter wire member 10), generally designated 30, for assisting in cutting paper 210 that is unrolled from the roll 200 and that is adjacent to (i.e., on and along) the displaceable stationary single-strand cutter wire member 20 (as shown in FIG. 1), wherein this paper-cutting assisting means 30 is movable along the stationary single-strand cutter wire member 20.

Figure 4:
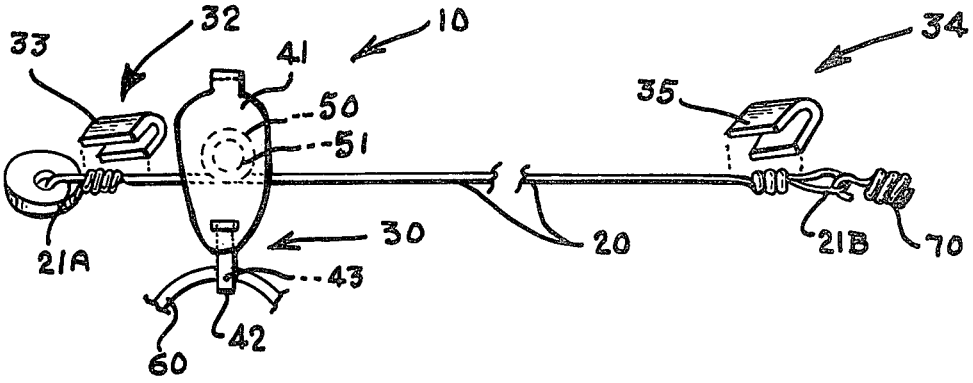
FIG. 4 is a front view, in simplified form, both pictorial and schematic, and partially fragmented, of the preferred embodiment of the invention shown in working environment in FIG. 1.
Figure 5A:
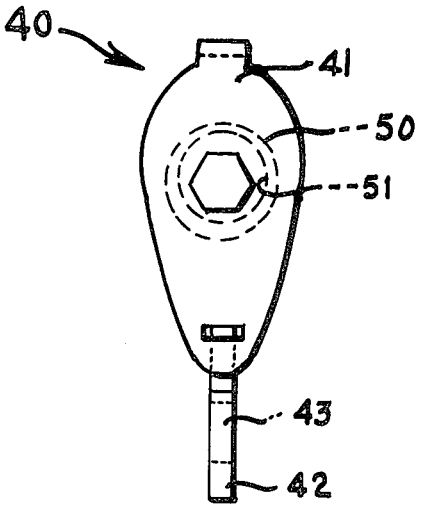
FIGS. 5A and 5B are, respectively, front and side elevation views, in simplified form, of some constituent members of the preferred embodiment of the invention.
Figure 5B:
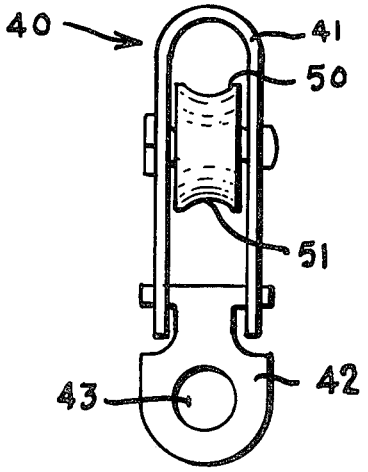
Figure 6C:
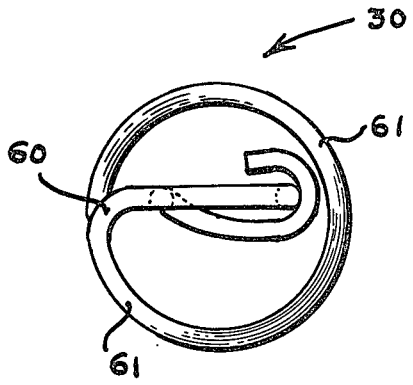
FIGS. 6A, 6B and 6C are, respectively, front, side elevation, and top views, in simplified form, of a constituent member of the preferred embodiment of the invention.
Figure 6A:
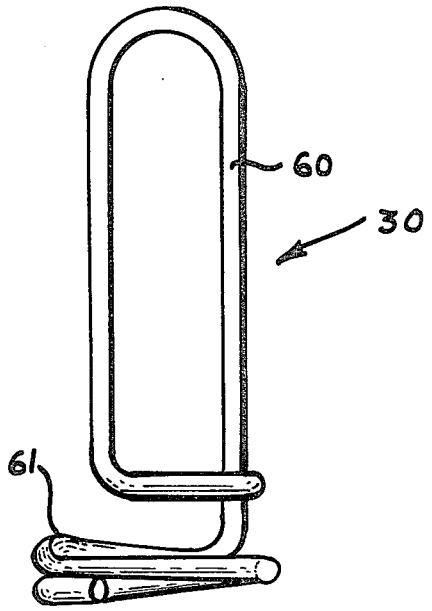
Figure 6B:
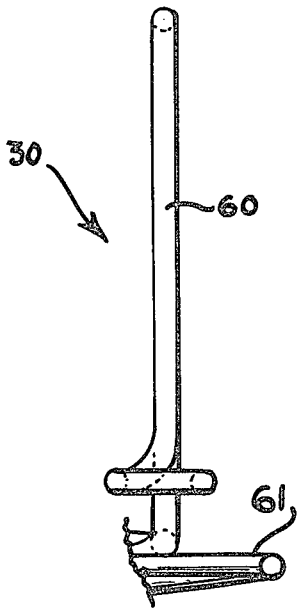

More specifically, and with reference particularly to FIGS. 4 and 1, the stationary single-strand cutter wire 20, has a first end 21A that is fixedly positioned and a second end 21B that is releasably connected to a biasing means 70, such as a spring, FIGS. 4 and 1. The paper-cutting assisting means 30 includes means 32 for securing the fixedly positioned first end 21A of the cutter wire member 20, and means 34 for securing the second end 21B of the cutter wire member 20 to the biasing means 70. As a matter of preference and not of limitation, these two securing means 32 and 34 each include a similarly structural member, e.g., a split side sinker. A first split side sinker member 33 of securing means 32 is preferably made of lead, and is press-fitted over the first end 21A of the cutter wire member 20 which is looped and coiled (e.g., "knotted"). Similarly, a second split side sinker member 35 of securing means 34 also is preferably made of lead, and is press-fitted over the second end 21B of the cutter wire member 20 which also is looped and coiled (e.g., "knotted").

With reference to FIGS. 1 and 4–6, inclusive, the movable paper-cutting assisting means 30 further includes: (a) a frame member 40 (best seen in FIG. 5) which comprises a first portion 41 in the shape of an inverted "U" and a second portion 42 connected to the first portion 41 in a transverse position, with the second portion 42 having a hole 43 therein; (b) a pulley member 50 (best seen in FIG. 5) that is connected to, and is rotatable within, the first portion 41 of the frame member 40, with this pulley member 50 having a grooved rim 51; and, (c) a handle member 60 (best seen in FIG. 6) that is connected to the transverse second portion 42 of the frame member 40 by, and at, the hole 43 therein, as is shown in FIGS. 4 and 1.

As a matter of preference and not of limitation, the stationary single-strand cutter wire member 20 has a diameter of 0.031 of an inch and is made of cold rolled steel; the frame member 40 and the pulley member 50 of the movable paper-cutting assisting means 30 are made of metal; and, the handle member 60 of the movable paper-cutting assisting means 30 is made of round brass wire and has a hand heel rest 61.

MANNER OF OPERATION AND OF USE OF THE PREFERRED EMBODIMENT

The manner of operation and of use of the preferred embodiment 10 of my inventive paper cutter assembly can be easily ascertained by any person of ordinary skill in the art from the foregoing description, coupled with reference to the Figures of the drawings.

For others, it is sufficient to say in explanation that, when paper 210 is unrolled from the paper roll 200 and is positioned adjacent to (i.e., on and along), the displaceable stationary single-strand cutter wire member 20 as shown in FIG. 1, and that when thereafter the paper-cutting assisting means 30 is pulled toward the operator 500 and is moved along the displaceable stationary cutter wire member 20 (by grasping the handle member 60 with the hand) across the width "W" of the unrolled paper 212, then the unrolled paper 212 is cut straightly, cleanly, quickly, and safely (i.e., without danger to the operator) from the rest of the roll 200 of paper by the movement of the displaced wire member 20.

CONCLUSION

It is abundantly clear from all of the foregoing, and from the Figures of the drawings, that the stated and desired principal object of this invention, and related objects thereof, have been achieved.

It is to be noted that, although there have been described and shown the fundamental and unique features of my invention as applied to a preferred embodiment thereof, various other embodiments, variations, adaptations, substitutions, additions, omissions, and the like may occur to, and can be made by, those of ordinary skill in the art, without departing from the spirit of my invention.

What is claimed is:

1. A paper cutter assembly, in combination with a roll of paper having a width, and with a means for supporting and unrolling said paper from said roll, comprising:

a. a displaceable stationary single-strand cutter wire member disposed across said width of said roll of paper and simultaneously disposed so as to be adjacent to and under and along said paper when said paper is unrolled;

b. and, means, cooperatively useable with said displaceable stationary single-strand cutter wire member, for assisting in cutting paper unrolled from said roll and that is positioned adjacent to and on and along said displaceable stationary single-strand cutter wire member, wherein this paper-cutting assisting means is movable along said displaceable stationary single-strand cutter wire member, and wherein said movable paper-cutting assisting means further includes:

(1) a frame member comprising a first portion in the shape of an inverted "U" and a second portion connected to said first portion in a transverse position, with said second portion having a hole therein;

(2) a pulley member connected to, and rotatable within, said first portion of said frame member, with said pulley member having a grooved rim;

(3) and, a handle member removably connected to said transverse second portion of said frame member by, and at, said hole therein;

whereby, when paper unrolled from said roll is positioned adjacent to, and is positioned on and along, said displaceable stationary single-strand cutter wire member, and when thereafter said single-strand wire member is pulled and is displaced with the use of said paper-cutting assisting means which is pulled and is moved along said cutter wire member and along said width of said unrolled paper, then said unrolled paper is cut straightly, cleanly, quickly, and safely from said roll by said movement of said displaced wire cutter member.

2. A paper cutter assembly, as set forth in claim 1, wherein said handle member of said movable paper-cutting assisting means is made of wire and has a hand heel rest.

3. A paper cutter assembly, as set forth in claim 2, wherein:

a. said displaceable stationary single-strand cutter wire member:

(1) has a diameter of 0.031 of an inch;

(2) is made of cold rolled steel;

(3) has a first end that is fixedly positioned, with said first end secured in said position by a first split side sinker made of lead that is press-fitted over said first end which is looped and coiled;

(4) and, has a second end that is releasably connected to a biasing means, with said second end secured to said biasing means by a second split side sinker that is similar to said first split side sinker and that is made of lead and is press-fitted over said second end which is looped and coiled;

b. said frame member and said pulley member of said movable paper-cutting assisting means are each made of metal;

c. and, said handle member of said movable paper-cutting assisting means is made of round brass wire.

* * * * *